US007312701B2

(12) United States Patent
Lin

(10) Patent No.: US 7,312,701 B2
(45) Date of Patent: Dec. 25, 2007

(54) METHOD AND SYSTEM FOR ENVIRONMENT DETECTION

(75) Inventor: Chun-Hung Lin, Taipei (TW)

(73) Assignee: Compel Communications, Inc., Neihu, Taipei (TW)

( * ) Notice: Subject to any disclaimer, the term of this patent is extended or adjusted under 35 U.S.C. 154(b) by 196 days.

(21) Appl. No.: 11/187,237

(22) Filed: Jul. 22, 2005

(65) Prior Publication Data

US 2006/0145843 A1 Jul. 6, 2006

(30) Foreign Application Priority Data

Dec. 28, 2004 (TW) ..... 93140919 A

(51) Int. Cl.
*G08B 1/08* (2006.01)

(52) U.S. Cl. ..... 340/539.26; 340/517; 340/521; 340/539.22; 340/825.36; 340/7.52; 340/7.59; 370/254

(58) Field of Classification Search ..... 340/539.26, 340/517, 521, 539.22, 541, 825.36, 7.52, 340/7.59, 506, 539.14, 531, 314, 511; 370/254
See application file for complete search history.

(56) References Cited

U.S. PATENT DOCUMENTS 6,023,223 A * 2/2000 Baxter, Jr. ..... 340/531
6,661,340 B1 * 12/2003 Saylor et al. ..... 340/517
7,076,211 B2 * 7/2006 Donner et al. ..... 455/41.2

FOREIGN PATENT DOCUMENTS

TW 540016 5/2001

* cited by examiner

*Primary Examiner*—Anh V. La
(74) *Attorney, Agent, or Firm*—Winston Hsu

(57) ABSTRACT

A method for environment detection to be implemented by a system, which includes a detection module and a control module, includes the steps of establishing a wireless communications link between the detection module and the control module, enabling the detection module to generate a warning signal that is transmitted wirelessly by the detection module when the detection module detects occurrence of an abnormal environment condition, and enabling the control module to receive the warning signal from the detection module through the wireless communications link and to process the warning signal accordingly. A system for realizing the method is also disclosed.

17 Claims, 5 Drawing Sheets

METHOD AND SYSTEM FOR ENVIRONMENT DETECTION

CROSS-REFERENCE TO RELATED APPLICATION

This application claims priority of Taiwanese application no. 093140919, filed on Dec. 28, 2004.

BACKGROUND OF THE INVENTION

1. Field of the Invention

This invention relates to a system for environment detection, more particularly to a system for environment detection that can be moved, rearranged or reconfigured with relative ease.

2. Description of the Related Art

A conventional system for environment detection includes a detection module and a control module. The detection module is operable so as to generate a warning signal when the detection module detects occurrence of an abnormal environment condition. The control module is operable so as to receive and process the warning signal from detection module.

The aforementioned conventional system is disadvantageous in that the control module and the detection module are connected electrically via electrical wiring. As such, once installed, the system is not easy to be moved, rearranged or reconfigured. This is highly undesirable when portability of the system is essential.

SUMMARY OF THE INVENTION

Therefore, the object of the present invention is to provide a system for environment detection that can be moved, rearranged or reconfigured with relative ease.

Another object of the present invention is to provide a method for environment detection that can implemented with relative ease.

According to one aspect of the present invention, a system for environment detection comprises a detection module and a control module. The detection module is operable so as to generate a warning signal that is transmitted wirelessly when the detection module detects occurrence of an abnormal environment condition. The control module is operable so as to receive and process the warning signal transmitted by the detection module.

According to another aspect of the present invention, a method for environment detection is to be implemented by a system that includes a detection module and a control module, and comprises the steps of:

A) establishing a wireless communications link between the detection module and the control module;

B) enabling the detection module to generate a warning signal that is transmitted wirelessly by the detection module when the detection module detects occurrence of an abnormal environment condition; and C) enabling the control module to receive the warning signal from the detection module through the wireless communications link and to process the warning signal accordingly.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
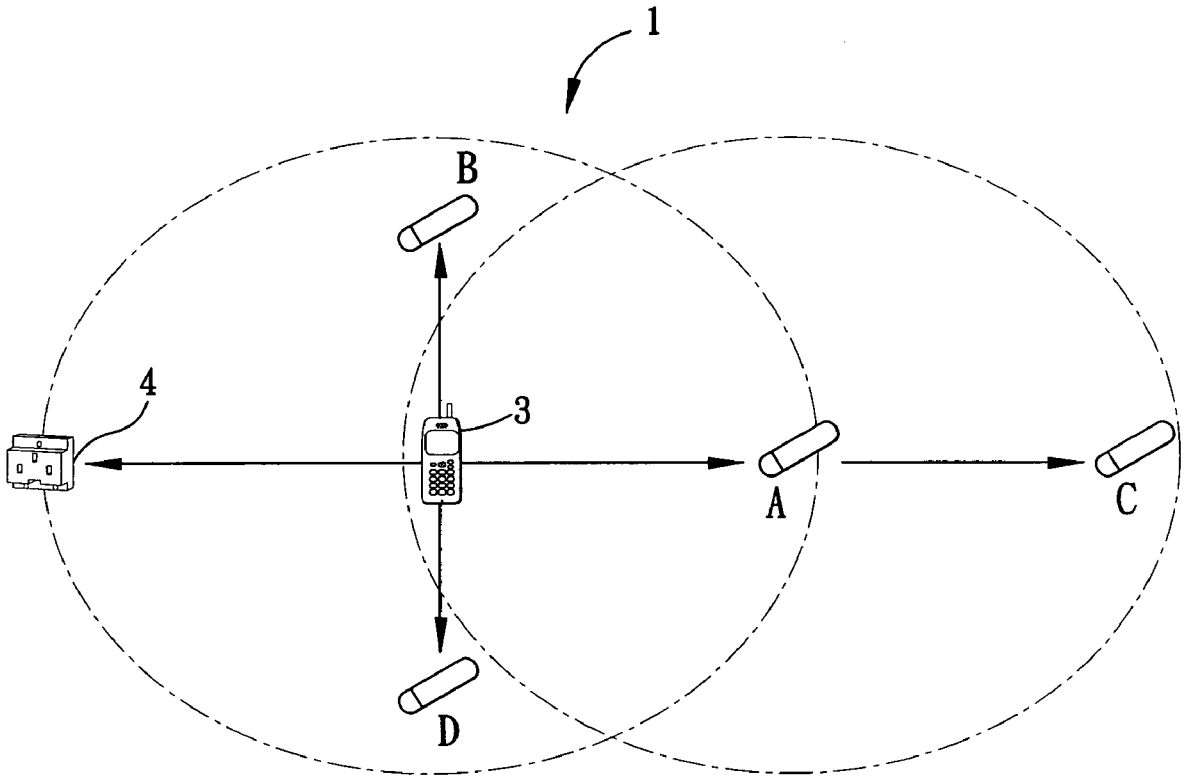
FIG. 1 is a schematic view of the preferred embodiment of a system for environment detection according to the present invention.
Figure 2:
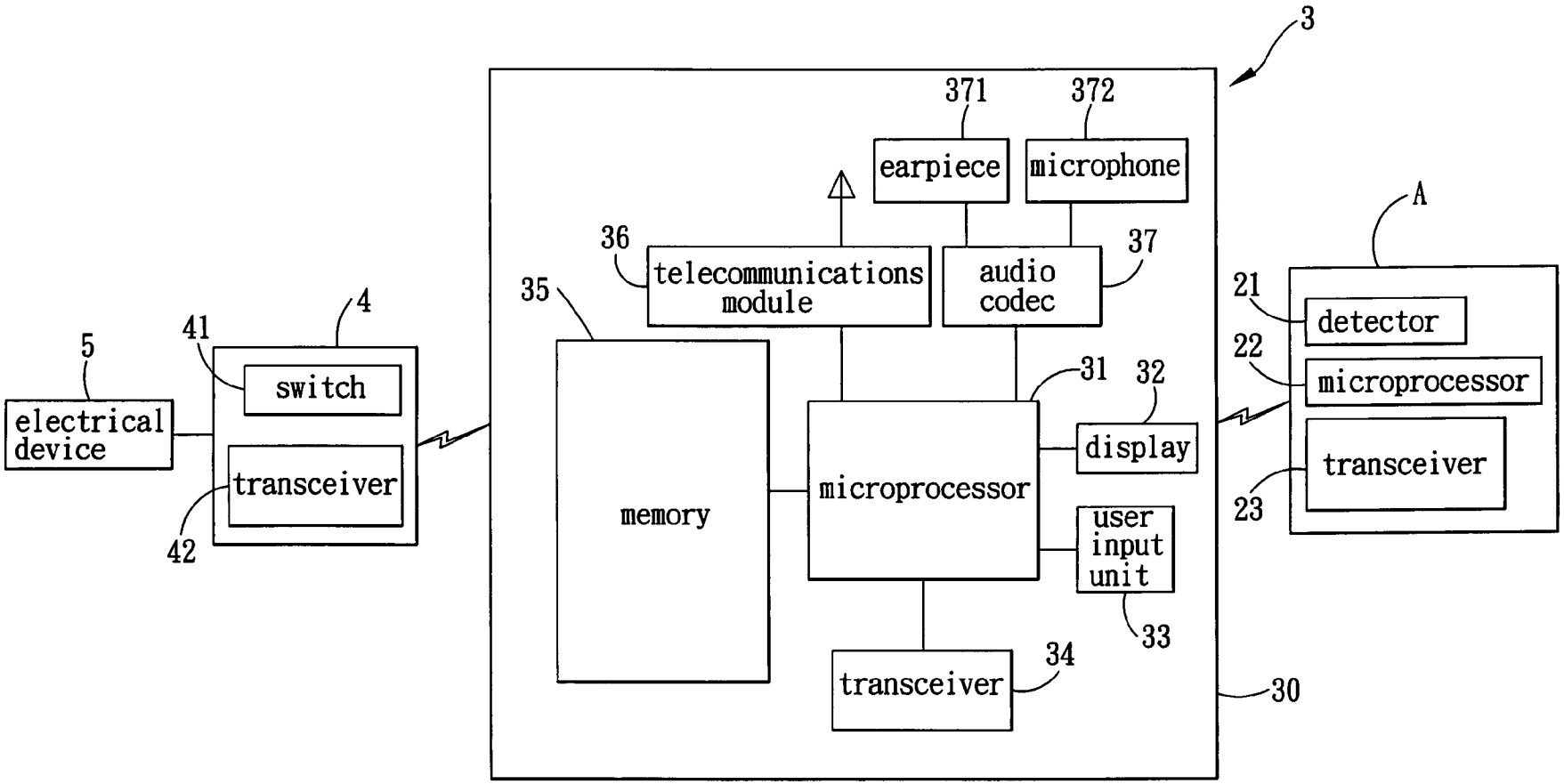
FIG. 2 is a schematic block diagram of the preferred embodiment.

Referring to FIGS. 1 and 2, the preferred embodiment of a system 1 for environment detection according to this invention is shown to include a plurality of first detection modules (A, B, D) and a control module 3.

Each of the first detection modules (A, B, D) is disposed within a wireless transmission range of the control module 3. Since the first detection modules (A, B, D) are the same, only one will be described hereinafter. In this embodiment, the first detection module (A) includes a detector 21, a microprocessor 22, and a transceiver 23.

The first detection module (A) is operable so as to generate a warning signal that is transmitted wirelessly when the detector 21 of the first detection module (A) detects occurrence of an abnormal environment condition. In this embodiment, the detector 21 of the first detection module (A) may be one of a vibration detector, a sound detector, a light detector, a temperature detector, a smoke detector, a humidity detector, an infrared detector, and a switch detector.

It is noted that the warning signal may contain a value, such in degrees, or a "1" or a "0".

It is noted that the first detection module (A) is configured with a unique identification code and a password.

The microprocessor 22 of the first detection module (A) is operable so as to manage operation of the first detection module (A), so as to process the warning signal that is generated by the detector 21 of the first detection module (A), and so as to store the identification code and the password of the first detection module (A).

The transceiver 23 of the first detection module (A) is operable so as to transmit the warning signal wirelessly. In this embodiment, the transceiver 23 of the first detection module (A) employs short range wireless technology, such as that of the Wi-Fi, the Bluetooth, the ZigBee, the ultra wideband, and the near field communications (NFC). In an alternative embodiment, the transceiver 23 of the first detection module (A) employs non-standardized radio frequency (RF) technology.

The control module 3 is operable so as to establish a wireless communications link with the first detection module (A) such that the control module 3 is able to receive and process the warning signal from the first detection module (A).

In this embodiment, the control module 3 includes a casing 30, a microprocessor 31, a display 32, a user input unit 33, a transceiver 34, and a memory 35.

The casing 30 of the control module 3 houses the microprocessor 31, the display 32, the user input unit 33, the transceiver 34, and the memory 35 of the control module 3.

The microprocessor 31 of the control module 3 is operable so as to manage operations of the control module 3, and so as to receive and process the warning signal transmitted by the first detection module (A).

The display 32 of the control module 3 is operable so as to show relevant information thereon.

In this embodiment, the control module 3 is integrated into an electronic device, such as a mobile phone or a personal digital assistant (PDA). In this embodiment, the electronic device includes a telecommunications module 36, an audio codec 37, an earpiece 371, and a microphone 372. Since the feature of the present invention does not reside in the particular configuration of the electronic device, a detailed description of the same is omitted herein for the sake of brevity.

The user input unit 33 of the control module 3 may be one of a keypad or a touch pad. User inputs can be inputted through the user input unit 33 of the control module 3 so as to dial a phone number, edit a phone book, and configure the control module 3. In this embodiment, the control module 3 may be configured such that the control module 3 generates a loud sound, or sends out a text message or a pre-recorded voice message in response to the warning signal from the first detection module (A), or relays the warning signal from the first detection module (A) to a remote server.

The electronic device is further integrated with several built-in functions, such as a calendar, a calculator, games, etc, in a conventional manner. Each of the built-in functions may be selected from a main menu of the electronic device via the user input unit 33 of the control module 3.

The transceiver 34 of the control module 3 is operable so as to receive the warning signal wirelessly. In this embodiment, the transceiver 34 of the control module 3, like the transceiver 23 of the first detection module (A), employs short range wireless technology, such as that of the Wi-Fi, the Bluetooth, the ZigBee, the ultra wideband, and the near field communications (NFC).

The memory 35 of the control module 3 is used to store program instructions for the control module 3, configurations of the control module 3, and the identification code and password of the first detection module (A).

The system 1 further includes a second detection module (C) that is disposed within a wireless transmission range of the first detection module (A) and that is disposed out of the wireless transmission range of the control module 3, as best shown in FIG. 1. In this embodiment, the second detection module (C), like the first detection module (A), includes a detector, a microprocessor, and a transceiver. Since the detector, the microprocessor, and the transceiver of the second detection module (C) are the same in construction and operation as those of the detector 21, the microprocessor 22, and the transceiver 23 of the first detection module (A), a detailed description is omitted herein for the sake of brevity.

It is noted that the second detection module (C), like the first detection module (A), is configured with a unique identification code and a password.

It is noted that the control module 3 is configured with the identification code and the password of each of the first and second detection modules (A, B, C, D).

The control module 3 is further operable so as to control the first detection module (A, B, or D) to establish a wireless communications link with the second detection module (C) such that the control module 3 is able to receive the warning signal from the second detection module (C) through the first detection module (A, B, or D) and to process the warning signal from the second detection module (C).

In this embodiment, the first detection module (A, B, or D) is further operable so as relay the warning signal from the second detection module (C) to the control module 3 when the warning signal from the second detection module (C) was not previously received by the first detection module (A, B, or D). On the other hand, the first detection module (A, B, or D) simply ignores the warning signal from the second detection module (C) when the warning signal from the second detection module (C) was previously received by the first detection module (A, B, or D).

The system 1 further includes a switch module 4 that is disposed within the wireless transmission range of the control module 3. In this embodiment, the switch module 4 includes a switch 41 and a transceiver 42. The control module 3 is further operable so as to generate a switch control signal, which is transmitted to the switch module 4 for controlling switching activity of the switch 41 of the switch module 4, when the control module 3 receives the warning signal from the first detection module (A, B, or D).

The switch 41 of the switch module 4 controls activated and deactivated status of an electrical device 5, such as an air conditioner. That is, the switch 41 of the switch module 4 activates the electrical device 5 when the switch 41 of the switch module 4 receives the switch control signal from the control module 3 and when the electrical device 5 is in the deactivated status. On the other hand, the switch 41 of the switch module 4 deactivates the electrical device 5 when the switch 41 of the switch module 4 receives the switch control signal from the control module 3 and when the electrical device 5 is in the activated status.

The transceiver 42 of the switch module 4 is operable so as to receive the switch control signal wirelessly.

Figure 3A:
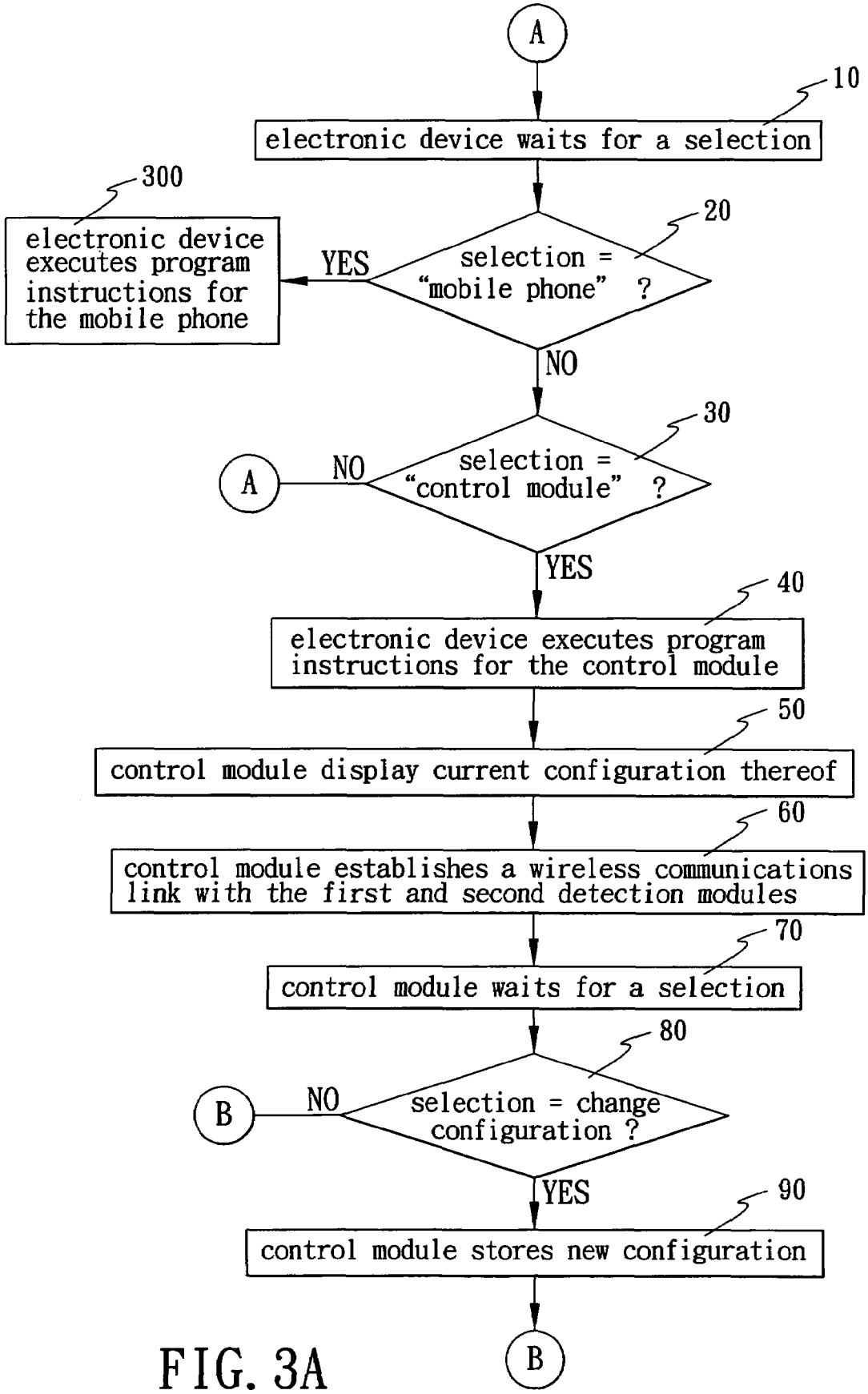
FIGS. 3A to 3C are flowcharts to illustrate the preferred embodiment of a method for environment detection according to the present invention.
Figure 3B:
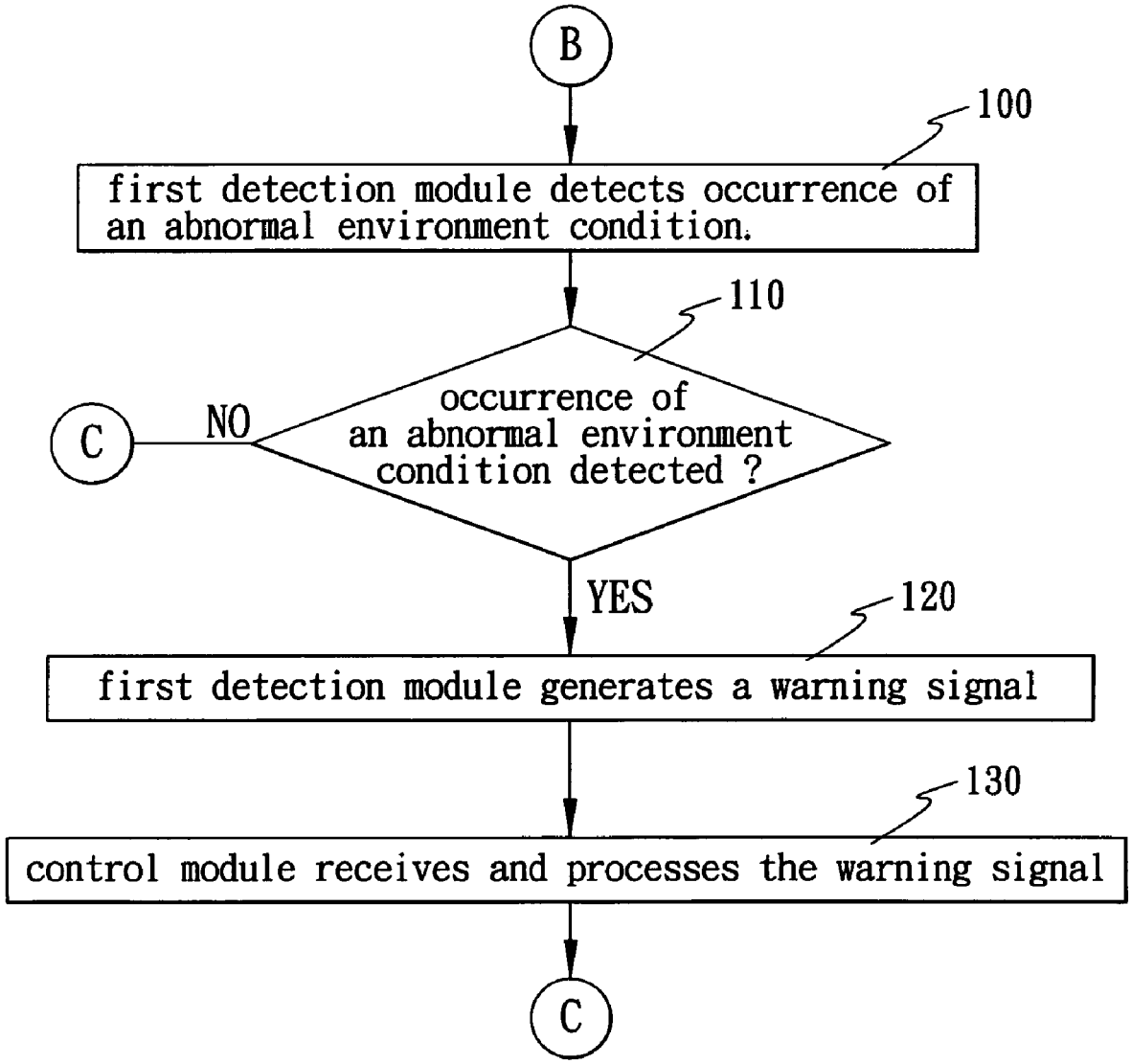
Figure 3C:
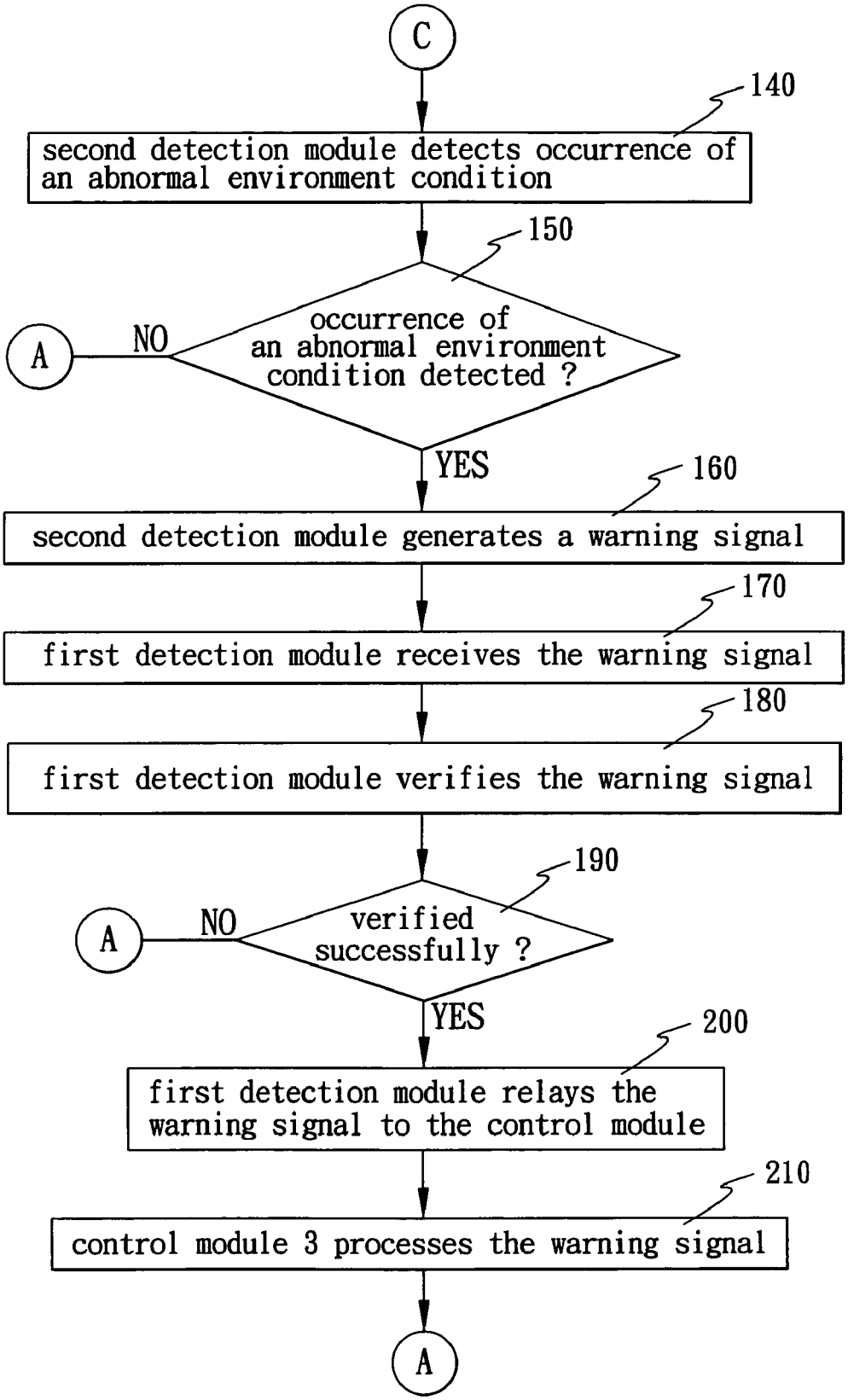

The preferred embodiment of a method for environment detection to be implemented by the system 1 according to this invention will now be described with further reference to FIGS. 3A to 3C.

In step 10, the electronic device waits for a selection.

In step 20, if the user selects the "mobile phone" from the main menu via the user input unit 33, the flow proceeds to step 300. Otherwise, the flow proceeds to step 30.

In step 30, if the user selects the "control module" from the main menu via the user input unit 33, the flow proceeds to step 40. Otherwise, the flow goes back to step 10.

In step 40, the electronic device executes the program instructions for the control module 3.

In step 50, the display 32 of the control module 3 displays the current configuration of the control module 3. Thereafter, in step 60, the control module 3 establishes a wireless communications link with the first and second detection modules (A, C).

In this embodiment, step 60 includes the sub-steps of:

enabling the control module 3 to detect the presence of the first detection module (A) and to request the first detection module (A) to transmit the identification code of the first detection module (A) enabling the first detection module (A) to transmit the identification code thereof in response to the request from the control module 3, and to request the control module 3 to transmit the password of the first detection module (A);

enabling the first detection module (A) to verify the password transmitted from the control module 3;

in response to a connection request from the control module 3, enabling the first detection module (A) to establish the wireless communications link with the control module 3 only upon successful verification of the password transmitted from the control module 3 (it is noted that the first detection module (A) verifies the password transmitted from the control module 3 with the use of the identification code and the password of the first detection module (A) that is configured therein);

in response to a search request from the control module 3, enabling the first detection module (A) to locate the second detection module (C) (it is noted that this sub-step includes the step of enabling the control module 3 to store the password and the identification code of the second detection module (C) in the memory 35 of the first detection module (A));

upon location of the second detection module (C), enabling the first detection module (A) to request the second detection module (C) to transmit the identification code of the second detection module (C);

enabling the second detection module (C) to transmit the identification code thereof to the first detection module (A) in response to the request from the first detection module (A), and to further transmit a request for the password of the second detection module (C);

in response to the request from the second detection module (C), enabling the first detection module (A) to transmit the password of the second detection module (C);

enabling the second detection module (C) to verify the password received from the first detection module (A); and in response to a connection request received from the first detection module (A), enabling the second detection module (C) to establish a wireless communications link with the first detection module (A) only upon successful verification of the password received from the first detection module (A).

In step 70, the control module 3 waits of a selection.

In step 80, if the user selects "change configuration" from the main menu via the user input unit 33, the flow proceeds to step 90. Otherwise, the flow proceeds to step 100.

In step 90, the control module 3 stores changes in the configuration made by the user.

In step 100, the detector 21 of the first detection module (A) detects for an occurrence of an abnormal environment condition.

In step 110, if the first detection module (A) detects the occurrence of an abnormal environment condition, the flow proceeds to step 120. Otherwise, the flow proceeds to step 140.

In step 120, the detector 21 of the first detection module (A) generates a warning signal that is transmitted wirelessly by the transceiver 23 of the first detection module (A).

In step 130, the microprocessor 31 of the control module 3 receives the warning signal from the first detection module (A) through the wireless communications link, and processes the warning signal accordingly.

In this embodiment, step 130 includes the sub-step of enabling the control module 3 to generate a switch control signal for controlling switching activity of the switch 41 of the switch module 4 when the control module 3 receives the warning signal from the first detection module (A);

In an alternative embodiment, step 130 may include at least one of the sub-steps of:

enabling the control module 3 to send out a text message to a designated recipient in response to the warning signal from the first detection module (A);

enabling the control module 3 to send out a pre-recorded voice message to a designated recipient in response to the warning signal from the first detection module (A); and enabling the control module 3 to relay the warning signal from the first detection module (A) to a remote server such that the remote server can act accordingly in response thereto.

In step 140, the detector of the second detection module (C) detects occurrence of an abnormal environment condition.

In step 150, if the detector of the second detection module (C) detects the occurrence of an abnormal environment condition, the flow proceeds to step 160. Otherwise, the flow goes back to step 10.

In step 160, the detector of the second detection module (C) generates a warning signal that is transmitted wirelessly by the transceiver of the second detection module (C).

In step 170, the first detection module (A) receives the warning signal from the second detection module (C).

In step 180, the first detection module (A) verifies whether the warning signal from the second detection module (C) was not previously received by the first detection module (A).

In step 190, if the warning signal from the second detection module (C) was not previously received by the first detection module (A), the flow proceeds to step 200. Otherwise, the first detection module (A) ignores the warning signal, and the flow goes back to step 10.

In step 200, the first detection module (A) relays the warning signal from the second detection module (C) to the control module 3.

In step 210, the microprocessor 31 of the control module 3 processes the warning signal from the second detection module (C) and relayed by the first detection module (A).

In this embodiment, step 210 may include at least one of the sub-steps of:

enabling the control module 3 to send out a text message to a designated recipient in response to the warning signal from the microprocessor of the first detection module (A);

enabling the control module 3 to send out a pre-recorded voice message to a designated recipient in response to the warning signal from the first detection module (A); and enabling the control module 3 to relay the warning signal from the first detection module (A) to a remote server such that the remote server can act accordingly in response thereto. Thereafter, the flow goes back to step 10.

In step 300, the electronic device executes the program instructions for the mobile phone.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A system for environment detection, comprising:

a first detection module operable so as to generate a warning signal that is transmitted wirelessly when said first detection module detects occurrence of an abnormal environment condition;

a second detection module disposed within a wireless transmission range of said first detection module, and operable so as to generate a warning signal that is transmitted wirelessly when said second detection module detects occurrence of an abnormal environment condition; and a control module operable so as to establish a wireless communications link with said first detection module, so as to receive and process the warning signal transmitted by said first detection module, and so as to control said first detection module to establish a wireless communications link with said second detection module such that said control module is able to receive the warning signal from said second detection module through said first detection module and to process the warning signal from said second detection module;

wherein said first detection module is disposed within a wireless transmission range of said control module, and wherein said second detection module is disposed out of the wireless transmission range of said control module.

2. The system as claimed in claim 1, wherein said first detection module is configured with an identification code and a password, said first detection module transmitting the identification code thereof and requesting said control module to transmit the password of said first detection module prior to establishing the wireless communications link with said control module, said first detection module verifying the password transmitted from said control module and establishing the wireless communications link with said control module only upon successful verification of the password transmitted by said control module.

3. The system as claimed in claim 2, wherein said second detection module is configured with an identification code and a password, said second detection module transmitting the identification code thereof to said first detection module, and requesting for transmission of the password of said second detection module prior to establishing the wireless communications link with said first detection module, said second detection module verifying the password received from said first detection module and establishing the wireless communications link with said first detection module only upon successful verification of the password received from said first detection module.

4. The system as claimed in claim 1, further comprising a switch module adapted to control activated and deactivated status of an electrical device, said control module being further operable so as to generate a switch control signal, that is transmitted to said switch module for controlling switching activity of said switch module, when said control module receives the warning signal from said first detection module.

5. The system as claimed in claim 1, wherein said control module is operable so as to send out a text message in response to the warning signal from said first detection module.

6. The system as claimed in claim 1, wherein said control module is operable so as to send out a pre-recorded voice message in response to the warning signal from said first detection module.

7. The system as claimed in claim 1, wherein said control module is operable so as to relay the warning signal from said first detection module to a remote server.

8. A method for environment detection to be implemented by a system that includes a first detection module and a control module, said method comprising:

A) establishing a wireless communications link between the first detection module and the control module;

B) enabling the first detection module to generate a warning signal that is transmitted wirelessly by the first detection module when the first detection module detects occurrence of an abnormal environment condition; and C) enabling the control module to receive the warning signal from the first detection module through the wireless communications link and to process the warning signal accordingly;

wherein step A) includes

A1) enabling the control module to detect the presence of the first detection module and to request the first detection module to transmit an identification code of the first detection module, A2) enabling the first detection module to transmit the identification code thereof in response to the request from the control module, and to request the control module to transmit a password of the first detection module, A3) enabling the first detection module to verify the password transmitted from the control module, and A4) in response to a connection request from the control module, enabling the first detection module to establish the wireless communications link with the control module only upon successful verification of the password transmitted from the control module.

9. The method as claimed in claim 8, the first detection module being disposed within a wireless transmission range of the control module, the system further including a second detection module disposed within a wireless transmission range of the first detection module and disposed out of the wireless transmission range of the control module, wherein step A) further includes:

A5) in response to a search request from the control module, enabling the first detection module to locate the second detection module;

A6) upon location of the second detection module, enabling the first detection module to request the second detection module to transmit an identification code of the second detection module;

A7) enabling the second detection module to transmit the identification code thereof to the first detection module in response to the request from the first detection module, and to further transmit a request for a password of the second detection module;

A8) in response to the request from the second detection module, enabling the first detection module to transmit the password of the second detection module;

A9) enabling the second detection module to verify the password received from the first detection module; and A10) in response to a connection request received from the first detection module, enabling the second detection module to establish a wireless communications link with the first detection module only upon successful verification of the password received from the first detection module.

10. The method as claimed in claim 9, wherein step A5) includes enabling the control module to store the password and the identification code of the second detection module in the first detection module.

11. The method as claimed in claim 9, further comprising:

D) enabling the second detection module to generate a warning signal that is transmitted wirelessly when the second detection module detects occurrence of an abnormal environment condition;

E) enabling the first detection module to relay the warning signal from the second detection module to the control module; and F) enabling the control module to process the warning signal from the second detection module and relayed by the first detection module.

12. The method as claimed in claim 11, wherein step E) is performed only when the warning signal from the second detection module was not previously received by the first detection module.

13. The method as claimed in claim 8, the system further including a switch module adapted to control activated and deactivated status of an electrical device, wherein step C) includes:

enabling the control module to generate a switch control signal for controlling switching activity of the switch module when the control module receives the warning signal from the first detection module.

14. The method as claimed in claim 13, wherein the switch control signal is transmitted wirelessly by the control module for reception by the switch module.

15. The method as claimed in claim 8, wherein step C) includes:

enabling the control module to send out a text message in response to the warning signal from said first detection module.

16. The method as claimed in claim 8, wherein step C) includes:

enabling the control module to send out a pre-recorded voice message in response to the warning signal from the first detection module.

17. The method as claimed in claim 8, wherein step C) includes:

enabling the control module to relay the warning signal from the first detection module to a remote server.

* * * * *